US009139998B1

(12) United States Patent
Conner, Jr. et al.

(10) Patent No.: US 9,139,998 B1
(45) Date of Patent: Sep. 22, 2015

(54) CULVERT CLEANING APPARATUS

(71) Applicants: Robert Lowell Conner, Jr., Mountain Home, AR (US); Grant Robert Conner, Mountain Home, AR (US)

(72) Inventors: Robert Lowell Conner, Jr., Mountain Home, AR (US); Grant Robert Conner, Mountain Home, AR (US)

( * ) Notice: Subject to any disclaimer, the term of this patent is extended or adjusted under 35 U.S.C. 154(b) by 0 days.

(21) Appl. No.: 14/152,758

(22) Filed: Jan. 10, 2014

Related U.S. Application Data

(60) Provisional application No. 61/779,436, filed on Mar. 13, 2013.

(51) Int. Cl.
*E03F 9/00* (2006.01)
*B08B 9/043* (2006.01)
*B08B 9/04* (2006.01)

(52) U.S. Cl.
CPC . *E03F 9/002* (2013.01); *B08B 9/04* (2013.01); *B08B 9/0436* (2013.01)

(58) Field of Classification Search
CPC ..... E03F 9/002; B08B 9/04; B08B 9/043; B08B 9/0436
USPC ..... 15/104.05, 104.16, 104.17–104.19, 15/104.31, 104.32
See application file for complete search history.

(56) References Cited

U.S. PATENT DOCUMENTS

| | | | | | |
|---|---|---|---|---|---|
| 202,519 | A | * | 4/1878 | Chapin | 15/104.31 |
| 1,919,549 | A | * | 7/1933 | Fryslie | 15/104.31 |
| 2,038,170 | A | * | 4/1936 | Flavin | 15/104.32 |
| 2,261,687 | A | * | 11/1941 | Lowry | 15/104.16 |
| 2,313,599 | A | * | 3/1943 | Surges | 15/104.32 |
| 2,328,060 | A | * | 8/1943 | Crane et al. | 15/104.31 |
| 2,402,314 | A | * | 6/1946 | Crane | 15/104.31 |
| 2,849,735 | A | * | 9/1958 | Thompson | 15/104.31 |
| 3,916,471 | A | * | 11/1975 | Maze | 15/104.31 |
| 6,000,152 | A | | 12/1999 | Tate | |
| 7,398,785 | B2 | | 7/2008 | Harr | |
| 7,725,978 | B2 | | 6/2010 | Harr | |
| 2013/0020264 | A1 | | 1/2013 | Reiss, Jr. | |

FOREIGN PATENT DOCUMENTS

CH 368434 * 3/1963

* cited by examiner

*Primary Examiner* — Mark Spisich
(74) *Attorney, Agent, or Firm* — Husch Blackwell LLP

(57) ABSTRACT

The present invention is directed to a culvert cleaning apparatus for attachment to a bucket of an earth moving machine. The culvert cleaning apparatus comprises a long shaft that has rotating arms attached to it. As the apparatus is inserted into a culvert and through a debris field the arms are pushed against the shaft to minimize the diameter of the apparatus. As the apparatus is removed from the culvert, the arms engage with debris, rotate outward to increase the functional diameter of the apparatus and pull/push debris out of the culvert.

16 Claims, 5 Drawing Sheets

CULVERT CLEANING APPARATUS

CROSS-REFERENCE TO RELATED APPLICATIONS

This Application claims priority to U.S. Provisional Patent Application No. 61/779,436 filed Mar. 13, 2013, entitled "Culvert Cleaning Apparatus," the entire disclosure of which is incorporated herein by reference.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

The present invention relates to attachments and assemblies used to clean out existing, in-place culverts used for water drainage below such things as roadways. Culverts often contain dirt, garbage, leaves, and the like that impede the culvert's primary function of draining water. This invention allows the user to leverage the power of earth moving machinery to remove obstructions from culverts.

Culverts, pipes, ditches, and other drainage structures are in wide use for such reasons as preventing soil erosion and controlling runoff. Culverts may be installed across or under roadways to prevent flooding of the roadway or to prevent water damage to the surrounding area. In other locations, culverts may be used to prevent alteration of the landscape by erosion, or shifting of the soil, for example. In some areas, controlling runoff from snowmelt is another issue that may be addressed, in part, by the use of culverts.

A culvert may lose its function if clogged with debris. Culverts become obstructed by soil, rocks, sand, intrusion of plant roots, snow, ice, or other debris. The location of some culverts makes them particularly susceptible to blockage. One way to address these problems is to place a covering or grating over the openings of the culvert. However, these coverings may require extensive and frequent cleaning and may allow smaller objects such as sand, silt, and gravel to enter the culvert. Additionally, coverings and gratings may not prevent plant roots from clogging the culvert. Culverts can be removed and replaced periodically but replacement may involve disturbing existing roadways and other structures which increases costs.

In the past, cleaning culverts often required a person entering the culvert and using hand tools, such as long shovels, hoes, and rakes, or using pressurized water from a hose to remove obstructions like dirt, leaves, and trash. These methods are limited by the strength of the person or the power of the water in the hose. Furthermore, the ability to reach obstructions in long culverts depended on whether the culvert was large enough in diameter for a person to enter it and reach the obstruction with hand tools. The use of water pressure is also limited by the access to a water source and capability of creating enough pressure to remove obstructions in long culverts.

The use of a culvert cleaning apparatus in conjunction with a motorized device is known in the art. U.S. Publication No. 2013/0020264 to Reiss, Jr. discusses a trash rake system for use in clearing debris from an intake screen of a water use facility. The intake screen is configured to collect debris transported by water, for example, a river, and prevent the debris from entering the intake port of the water use facility. The trash rake system includes a track system, a movable support structure, a rack and pinion drive mechanism, and a controller configured to receive signals from an encoder on a drive motor and a proximity sensor system.

U.S. Pat. Nos. 7,398,785 and 7,725,978 to Harr discuss tools for cleaning culverts. The tools comprise a rod having a center longitudinal axis. Various housings are coupled coaxially to one end of the rod. One such housing contains rotating cutting instruments. Another housing functions as a scoop. All of the tools are designed for insertion into a culvert to cut, push, or pull debris from the culvert. All of the tools are utilized as attachments to a motorized device such as a tractor.

Similarly, U.S. Pat. No. 6,000,152 to Tate discusses a culvert cleaning apparatus for use with earth moving machinery having a bucket, such as a backhoe or trackhoe. The apparatus has an attachment assembly for connection to the machinery's bucket. An arm extends from the attachment assembly. A scoop is attached to the end of the arm opposite the attachment assembly. Extensions between the attachment assembly and the scoop are provided when extended reach is desired. The machine may be used to push the scoop into a culvert and scoop out material clogging the culvert.

While the above-described devices fulfill their respective, particular objectives and requirements, the aforementioned devices possess several deficiencies. One particular defect of the devices discussed in the references is that they are all fixed in size and width. The devices are not dynamic in nature. For example, the referenced tools cannot reduce their cross-section to push through a tight area nor can they expand to capture debris when the tool is removed from the culvert.

In contrast, the functional diameter of the claimed invention can change during use. As the tool of the present invention enters a culvert it possesses a first functional diameter. As it engages debris and is removed from the culvert it can possess a second functional diameter. In this regard, the present invention is an improvement over known designs. In this respect, the culvert cleaning tool according to the present invention substantially departs from the conventional concepts and designs of the prior art.

SUMMARY OF THE INVENTION

In view of the foregoing disadvantages inherent in the known methods and types of culvert cleaning devices now present in the prior art, the present invention provides an improved apparatus.

In broad terms, one aspect of the invention encompasses a culvert cleaning apparatus comprising a shaft having a first end and a second end and a body intermediate the first end and the second end. An attachment assembly is connected to the shaft wherein the attachment assembly is suitable for detachable engagement with a machine such as a backhoe or trackhoe. The apparatus also comprises a plurality of arm members connected to the shaft wherein the arms rotate from a first position adjacent the shaft to a second position.

Another aspect of the invention encompasses a culvert cleaning apparatus comprising a shaft having a first end and a second end and a body intermediate the first end and second end; an attachment assembly connected to the shaft wherein the attachment assembly is suitable for connecting to a machine; and a plurality of rotating arm members connected to the shaft wherein the arm members are capable of altering the functional diameter of the culvert cleaning apparatus.

Yet another aspect of the invention encompasses a method of cleaning a culvert containing debris. The method comprises the steps of inserting an apparatus into a culvert to engage debris, wherein upon insertion the apparatus has a first diameter, and then removing the apparatus from the culvert, wherein upon removal the apparatus has a second diameter that is greater than the first diameter. In this method the apparatus comprises a plurality of arm members connected to a shaft. The arm members rotate from a first position defining the first diameter to a second position defining the second diameter in response to the arm members engaging with debris.

BRIEF DESCRIPTION OF THE SEVERAL VIEWS OF THE DRAWINGS

The invention will be better understood when consideration is given to the following detailed description. Such description makes reference to the annexed drawings wherein.

DETAILED DESCRIPTION OF THE INVENTION

Figure 1:
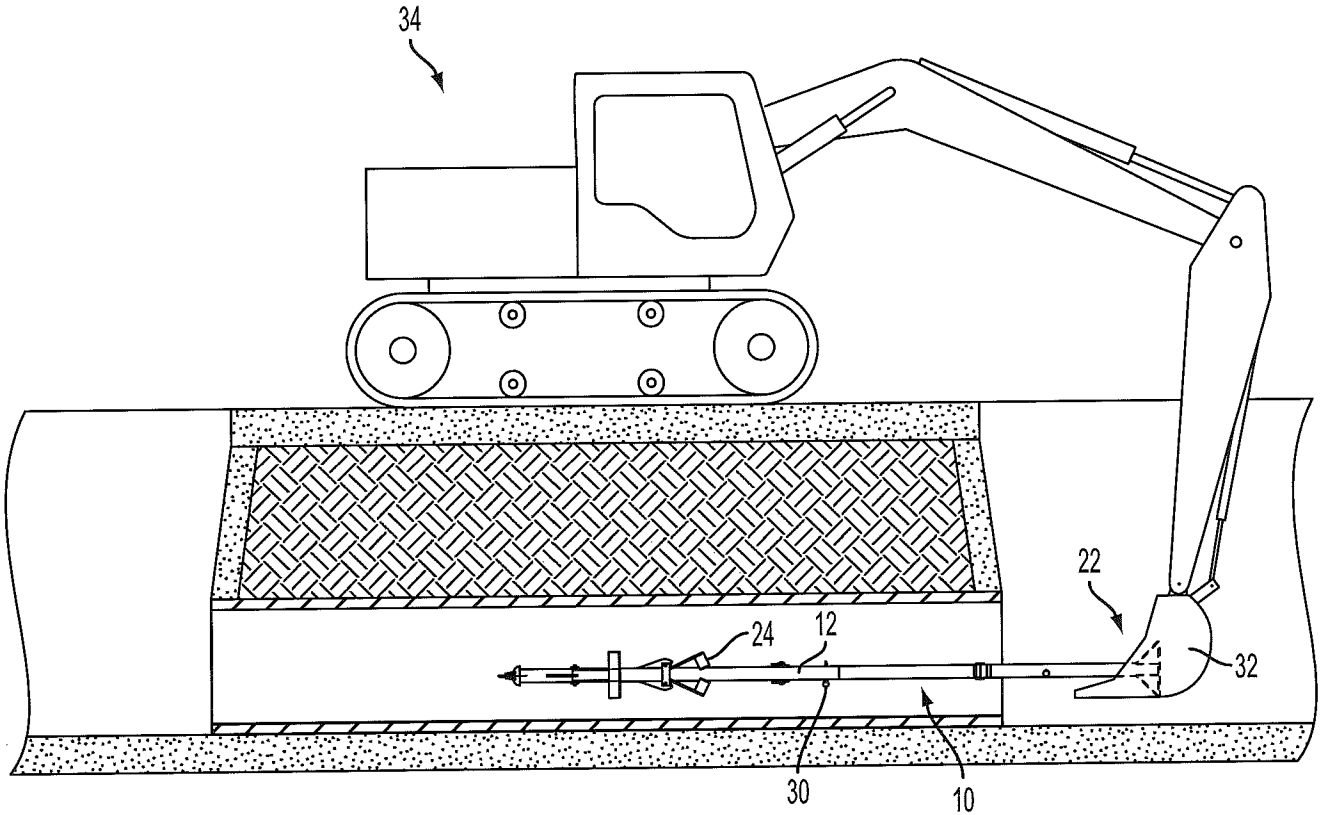
FIG. 1 is a side view of a trackhoe which sits on a roadway over a culvert with an embodiment of the invention attached to the trackhoe and inserted into a culvert.

Referring to the drawings, reference character 10 generally designates a culvert cleaning apparatus constructed in accordance with the present invention. In broad terms, the culvert cleaning apparatus 10 comprises a shaft 12, an attachment assembly 22 connected to the shaft 12, and a plurality of arm members 24.

The shaft 12 has a first end 14 and a second end 16 and a body 18 intermediate the first end 14 and second end 16. The shaft 12 is made of a material suitable for high stress and strain applications, such as insertion into a debris laden culvert and removal from a debris laden culvert. In preferred embodiments, the shaft 12 is made of a metal such as commercially available steel, aluminum, or other metals or suitable alloys thereof. In some applications plastics, polymers, fiberglass, or carbon fibers may be suitable materials for shaft construction. The shaft 12 may be a solid rod or tubing or a combination of the two. In particularly preferred embodiments the shaft 12 is made from three (3) inch square steel tubing which is readily available to those skilled in the art.

The length of the shaft 12 may vary according to need. In the practice of the invention a user may make multiple shafts of varying length to accommodate any particular length of culvert. This might be the preferred method for entities such as highway departments that may have many culverts having a fixed length.

Figure 4:
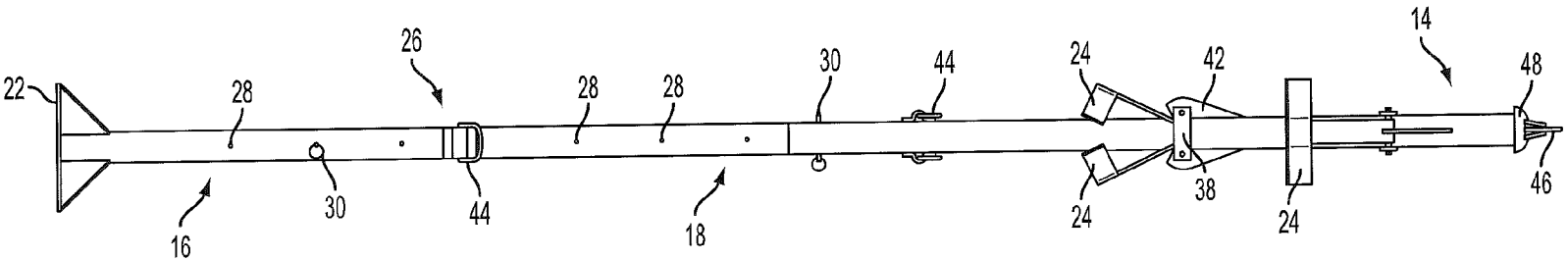
FIG. 4 is a side view of an embodiment of the invention with an attachment assembly.
Figure 5:
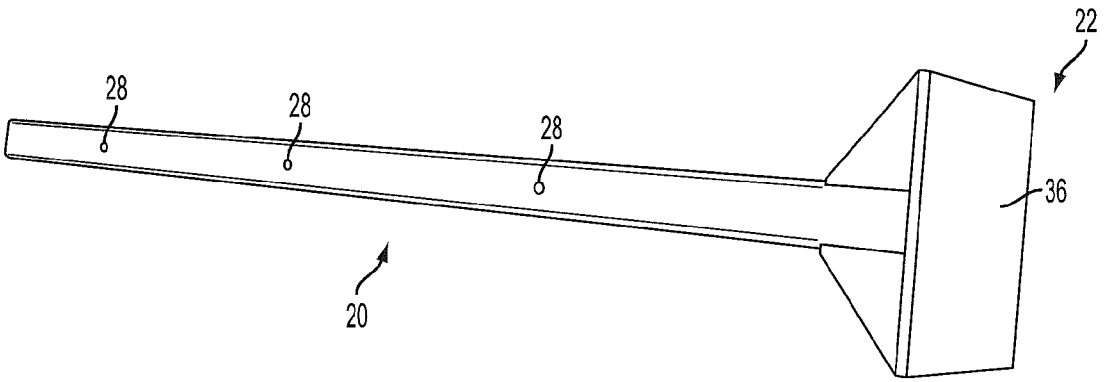
FIG. 5 is a perspective view of an extension utilized in one embodiment of the invention.

Alternatively, the shaft 12 may be paired with an extension 20 such as that shown in FIG. 5. In preferred embodiments, the extension 20 is made of the same or similar material as shaft 12. In the embodiments shown in FIGS. 3, 4 and 5 the extension 20 attaches to the first end 16 at the shaft.

In preferred embodiments the extension 20 and shaft 12 interact telescopically at the shaft/extension connecting point 26. In other words, either the extension 20 slides within the shaft 12 for a distance or the shaft 12 slides within the extension 20 for a distance. In particularly preferred embodiments, the telescopic interaction between the extension 20 and the shaft 12 is such that they may be connected together to create an apparatus of varying lengths. This may be accomplished by drilling multiple aligned holes 28 along the length of both the shaft 12 and the extension 20 as shown in FIGS. 4 and 5. The shaft 12 and extension 20 are then telescoped in or out to align the holes at desired positions. A pin 30 or pins is/are inserted through the aligned holes 28 to fix the relative positions of the shaft 12 and extension 20. In this manner the length of the overall apparatus can be changed to fit a particular need.

Figure 2:
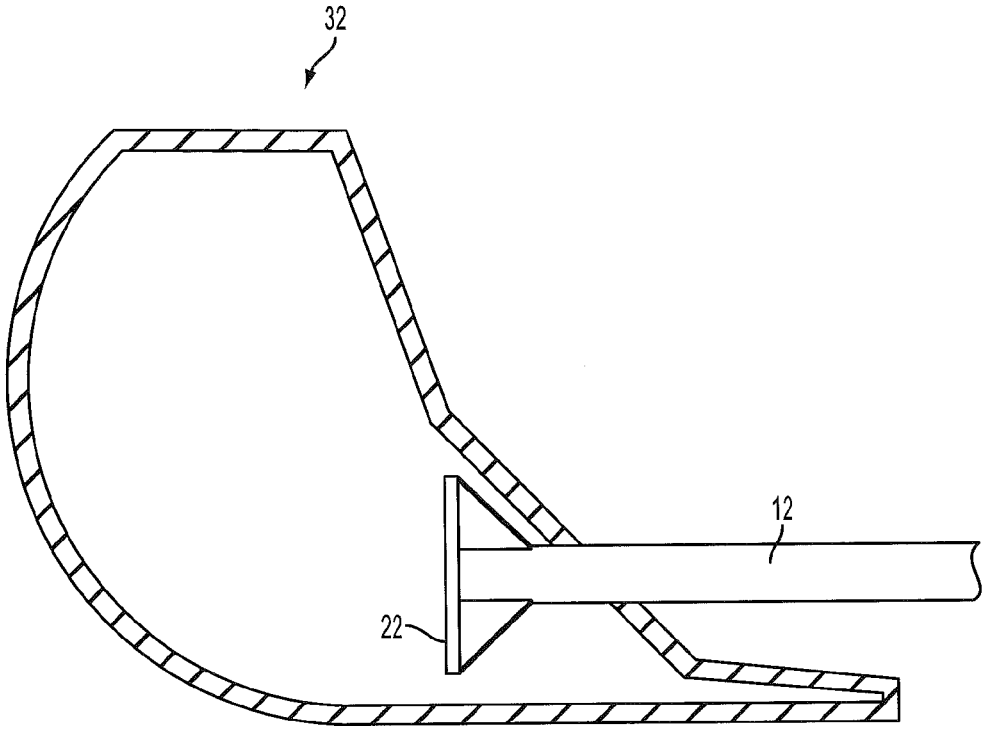
FIG. 2 is a sectional view schematically illustrating attachment of the invention to a bucket of an earth moving machine.

During use, the apparatus according to the invention is preferably attached to a machine to provide the power necessary to insert the apparatus into a culvert and remove it. The term machine includes, but is not limited to, a motorized device such as a self-propelled earth moving machine. Trackhoes, backhoes, and tractors with hydraulically controlled bucket attachments are examples of earth moving machines suitable for use with the invention. Alternatively, the apparatus according to the invention could be attached to a stationary machine that moves in a piston like fashion to insert the apparatus into and out of a culvert. For ease of discussion the apparatus according to the invention will be described in the context of attachment to an earth moving bucket as shown in FIGS. 1 and 2. This narrative convenience should not be interpreted as limiting the scope of the invention.

Turning to FIG. 4, an attachment assembly 22 is connected to the shaft 12. In preferred embodiments the attachment assembly 22 is made of the same material as the shaft 12. The connection between the attachment assembly 22 and the shaft 12 can be permanent as by welding. Alternatively, the attachment assembly 22 can be part of the extension 20 as shown in FIG. 5. Either mode of connection is encompassed by the phrase "connected to the shaft".

As shown in FIGS. 1 and 2, the attachment assembly 22 is detachably engaged to a machine during use (e.g., to the bucket 32 of a trackhoe 34). In the embodiments of the attachment assembly 22 shown in FIGS. 2 and 5, the attachment assembly 22 comprises a plate bracket 36 that is connected either to the shaft 12 (FIG. 2) or one end of an extension 20 (FIG. 5).

The plate bracket 36 is preferably sized to fit snugly within the interior of the bucket 32. The attachment assembly 22 may be permanently connected to the shaft 12 and/or extension 20 via welds. Alternatively, the attachment assembly 22 may be detachably connected to the shaft 12 and/or extension 20 via pins and holes. If the attachment assembly is detachably connected, it may be cost effective to have multiple plate brackets 36 of multiple dimensions to fit within different sized buckets. Those skilled in the art are capable of constructing plate brackets 36 suitable for use with any given bucket. Alternatively, one skilled in the art could utilize an adjustable attachment assembly such as the one discussed in U.S. Pat. No. 6,000,152, which is incorporated herein by reference in its entirety.

Figure 3:
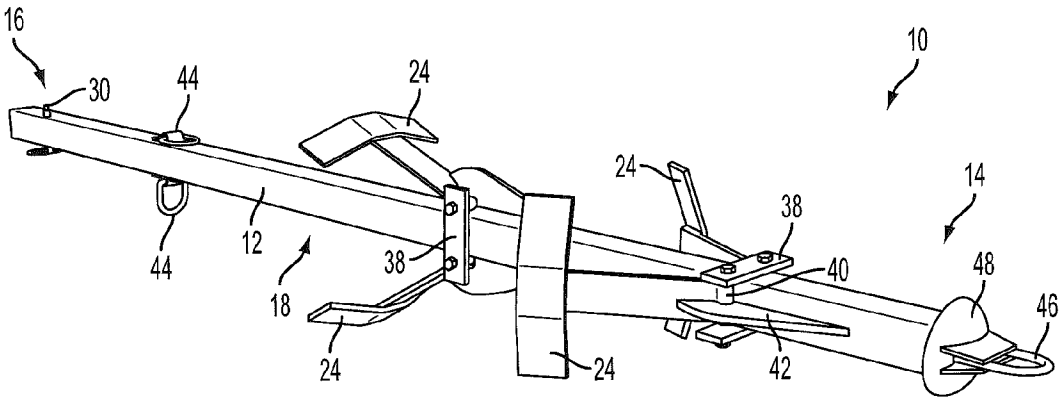
FIG. 3 is a perspective view of an embodiment of the invention without an extension or attachment assembly.
Figure 6:
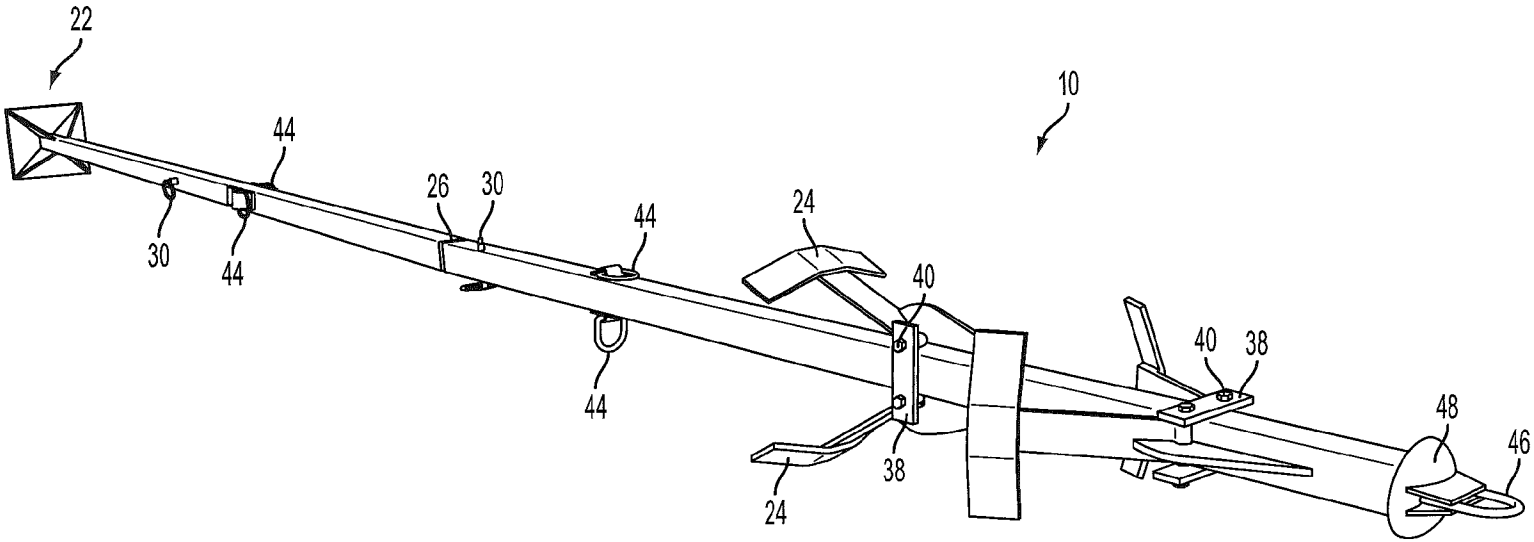
FIG. 6 is a perspective view of an embodiment of the invention.

The attachment assembly 22 is connected to a machine and secured in place by any of several appropriate detachable engagement means and devices. For example and as shown in FIGS. 3, 4 and 6, a plurality of "D" rings 44 may be welded to the shaft body 18. These "D" rings are points of attachment for chains (not shown) that are then connected to the machine (e.g., trackhoe bucket). Alternatively, the attachment assembly 22 plate bracket 36 could have tabs that fit within matching slots cut in a bucket. The tabs would engage with the slots and be secured in place by pins. Other suitable methods of attaching the apparatus to a machine are known to those skilled in the art.

The culvert cleaning apparatus 10 further comprises a plurality of arm members 24. Preferably, the arm members 24 are fixably yet detachably connected to the shaft body 18 and rotate from a first position adjacent the shaft body 18 to a second position apart from the shaft body 18 as shown in FIG. 7.

The arm members 24 may comprise several shapes and configurations. As shown in FIGS. 3 and 6, the arm members 24 are generally planar and "T" shaped. The length of the arm members 24 may vary depending on the size of the culvert. The shape of the arm members 24 may vary depending on user preference. For example, instead of "T" shaped, the arm members 24 could be spoon shaped or simple elongated rectangles. The edges of the arm members could be rounded or sharpened depending on culvert construction and anticipated debris. The arm members 24 can be made from the same materials used to construct the shaft 12 and any extension 20. Those skilled in the art are capable of designing an arm member suitable for a particular application.

One of the benefits of the apparatus according to the invention is that the functional diameter of the apparatus is dynamic during use. In other words, because the arm members 24 rotate, the functional diameter of the apparatus can move from a minimized position to a maximized position.

Figure 7:
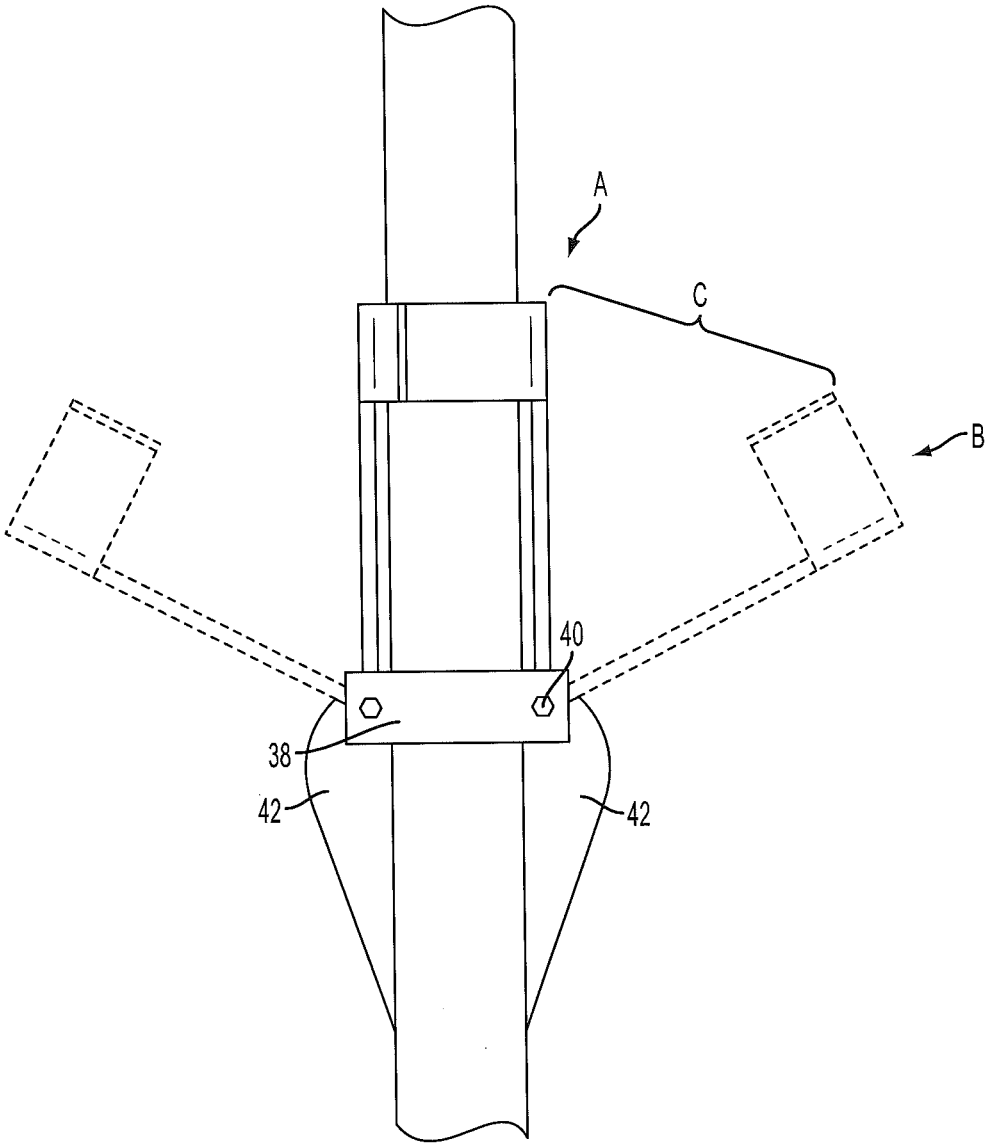
FIG. 7 is a side view illustrating dynamic movement of arm members to alter the functional diameter of the invention.

Generally speaking, the arm members 24 are configured to enter a culvert in a first position "A" (or minimized position) where the arm members 24 are proximate to the shaft 12 as shown in FIG. 7. When in the first or minimized position "A" the arm members 24 are generally parallel to the long axis of the shaft 12. The first or minimized position "A" schematically represents the minimal functional diameter of the apparatus during use.

In practice, the apparatus 10 is preferably pushed into and/or through a section of debris within a culvert. The resistance (e.g., frictional forces) encountered by and applied to the apparatus 10 as it passes into and through debris typically maintains the arm members 24 in the first position "A" during the insertion step.

As the movement of the apparatus 10 reverses and the apparatus is removed from the culvert, the direction of the resistance (e.g., frictional forces) encountered by and applied to the apparatus, specifically the arm members 24, reverses. As the apparatus leaves the culvert, the arm members 24 engage with debris which causes them to rotate outward to a second position "B" (or maximized position as shown in FIG. 7). This second position "B" represents the maximal functional diameter of the apparatus during use. The extended arm members 24 then carry debris out of the culverts as the apparatus is removed.

In other words, the rotation of the arm members 24 in response to changes in resistance applied to the apparatus alters the functional diameter of the apparatus during use. This process repeats until the culvert is cleared of debris.

The arm members 24 may be attached to the shaft 12 and/or extension 20 in any manner that allows them to rotate from a first position to a second position as shown in FIG. 7. The methods of attachment of the arm members shown in the Figures are exemplary.

Turning now to FIGS. 3, 4, 6, and 7, the plurality of arm members 24 are connected to the shaft 12 and/or shaft body 18 by hinges 38 and shear pins 40. The arm members 24 rotate about the shear pins 40 in an arcuate fashion to move from a first position "A" to a second position "B" as shown in FIG. 7.

The rotation of an arm member 24 is limited by a detent 42 connected to the shaft 12. The detent 42 shown in FIG. 7 is a rounded wing to reduce drag during insertion but other configurations are possible.

In some embodiments of the invention, the angular rotation of the arm members 24 is limited such that when the arm members are fully rotated, they are generally perpendicular to the shaft 12. This arrangement maximizes the functional diameter of the apparatus which maximizes its effectiveness in removing debris from a culvert. Stated alternatively, in some embodiments, the maximum amount of rotation of any arm member is 90 degrees. In particularly preferred embodiments, the amount of rotation is less than 90 degrees such that when the arm members 24 move from said first position "A" to a second position "B" the arm members form an acute angle "C" with the shaft 12. As used herein the term "acute angle" means an angle between 0 and 90 degrees and includes a 90 degree angle.

One can allow the arm members to rotate beyond 90 degrees, however this is not a preferred embodiment as it places the arm members 24 in a "swept back" position which allows debris to slide off the arm members rather than being captured by the arm members.

In those embodiments of the invention that utilize more than two arm members, it is preferred that those arm members are arranged in a staggered fashion around the circumference and along the length of the shaft 12 as shown in FIGS. 3 and 6. The staggered arrangement maximizes the functional diameter of the apparatus during use allowing for the removal of more debris.

In one preferred embodiment of the invention the shear pins 40 and/or the detents 42 and/or the hinges 38 have a tensile strength that is less than that of the shaft 12. This feature is beneficial because there could be occasions where the apparatus gets stuck within a culvert. Since the apparatus is preferably operated by a machine such as a backhoe, one can foresee instances where the apparatus gets stuck and is damaged or destroyed during attempts to remove it.

If the shear pins 40 and/or the detents 42 and/or the hinges are designed to fail or "breakaway" before the shaft 12 and/or an extension 20 are damaged, a user has the opportunity to save the main portion of the apparatus with only the loss of a shear pin or detent and possibly an arm member.

In another preferred embodiment, the shear pins 40 slide in and out of the hinges 38 and are held in place by cotter pins or other detachable means. This allows the user to detach and re-attach arm members 24 as desired. For example, if a user encounters round and oval shaped culverts it may be convenient to have a set of arm members of varying length or shape that are interchangeable with each other.

Preferably, the first end 14 at the apparatus 10 (i.e., the part of the apparatus opposite the attachment assembly) is defined in part by a ring 46 or other such attachment and a rounded cap 48. The rounded cap 48 helps the device traverse blockages. The ring 46 is a point of attachment that allows the option of pulling the apparatus 10 completely through culvert at minimum diameter if the apparatus 10 becomes stuck and backward movement is difficult.

The invention also encompasses a method of cleaning culverts. In light of the foregoing, the method according to the invention comprises inserting an apparatus into a culvert to engage debris, wherein upon insertion the apparatus has a first diameter. The method also comprises reversing the apparatus direction of movement to remove the apparatus from the culvert, wherein upon removal the apparatus has a second diameter that is greater than the first diameter.

In preferred embodiments the apparatus utilized in the method according to the invention is the apparatus described above. In short, the apparatus comprises a plurality of arm members connected to a shaft and said arm members rotate from a first position defining a first diameter of the apparatus to a second position defining a second diameter of the apparatus and wherein the rotation is in response to said arm members engaging with debris.

The foregoing describes various features of several embodiments according to aspects of the present disclosure. Those skilled in the art are capable of understanding the disclosure and modifying the invention's apparatus and methods to fit particular needs. Such equivalent constructions do not depart from the spirit and scope of this disclosure. Accordingly, the invention should not be defined solely by the examples discussed herein.

What is claimed is:

1. A culvert cleaning apparatus comprising:

a shaft having a first end and a second end and a body intermediate said first end and second end;

an attachment assembly connected to said shaft proximate said second end, said attachment assembly suitable for detachable engagement with a machine;

a first pair of arm members operably connected to said shaft proximate said first end, each of said first pair of arm members are pivotally coupled to said shaft and are disposed to rotate in a first plane; and a second pair of arm members operably connected to said shaft between said first pair of arm members and said second end, each of said second pair of arm members are pivotally coupled to said shaft and are disposed to rotate in a second plane, wherein said first plane is different than said second plane;

wherein each of said arm members freely and independently rotate between a first position adjacent to said shaft and a second position radially outward from said shaft.

2. A culvert cleaning apparatus according to claim 1 wherein each of said arm members rotate a maximum of 90 degrees.

3. A culvert cleaning apparatus according to claim 2 wherein said arm members form an acute angle with said shaft in a direction toward said second end when said arm members are in said second position.

4. A culvert cleaning apparatus according to claim 1 wherein each of said arm members are connected to said shaft by hinges and shear pins and wherein the tensile strength of said shear pins or hinges or both is less than that of said shaft.

5. A culvert cleaning apparatus according to claim 1 further comprising an extension attached to said shaft.

6. A culvert cleaning apparatus according to claim 1 wherein the functional diameter of the apparatus changes as one or more of said first pair or said second pair of said arm members rotate radially outward from said shaft.

7. A culvert cleaning apparatus according to claim 1 further comprising a detent to limit rotation of said arm members.

8. A culvert cleaning apparatus according to claim 1 wherein said arm members are detachable from said shaft body and are interchangeable with each other.

9. A culvert cleaning apparatus according to claim 1, wherein each of said arm members are "T" shaped.

10. A culvert cleaning apparatus according to claim 1, wherein each of said arm members have a first end and a second end, said first end pivotally coupled to said shaft and said second end disposed closer to said second end of said shaft than said first end of said arm member in said first position.

11. A culvert cleaning apparatus according to claim 1, wherein said first plane of rotation and said second plane of rotation are orthogonal.

12. A culvert cleaning apparatus comprising:

a shaft having a first end and a second end and a body intermediate said first end and second end;

an attachment assembly connected to said shaft proximate said second end, said attachment assembly suitable for detachable engagement with a machine;

a first pair of arm members operably connected to said shaft proximate said first end, said first pair of arm members comprising a first arm member and a second arm member, said first arm member pivotally coupled to said shaft and disposed for rotation about a first axis of rotation, said second arm member pivotally coupled to said shaft and disposed in an opposing relationship to said first arm member, said second arm member disposed for rotation about a second axis of rotation, wherein said first axis of rotation and said second axis of rotation are substantially parallel;

a second pair of arm members operably connected to said shaft between said first pair of arm members and said second end, said second pair of arm members comprising a third arm member and a fourth arm member, said third arm member pivotally coupled to said shaft and disposed for rotation about a third axis of rotation, said fourth arm member pivotally coupled to said shaft and disposed in an opposing relationship to said third arm member, said fourth arm member disposed for rotation about a fourth axis of rotation, wherein said third axis of rotation and said fourth axis of rotation are substantially parallel to each other and not parallel to said first axis of rotation and said second axis of rotation;

wherein each of said first, second, third, and fourth arm members independently and freely rotate between a first position adjacent to said shaft and a second position radially outward from said shaft.

13. A culvert cleaning apparatus according to claim 12 wherein each of said first, second, third, and fourth arm members form an acute angle with said shaft in a direction toward said second end when said arm members are in said second position.

14. A culvert cleaning apparatus according to claim 12 wherein the functional diameter of said apparatus is minimized during insertion into a culvert as said first, second, third, and fourth arm members are in said first position and maximized during withdrawal from the culvert as said first, second, third, and fourth arm members rotate radially outward from said shaft.

15. A culvert cleaning apparatus according to claim 12, wherein each of said first, second, third, and fourth arm members are "T" shaped.

16. A culvert cleaning apparatus according to claim 12, wherein each of said first, second, third, and fourth arm members have a first end and a second end, said first end pivotally coupled to said shaft and said second end disposed closer to said second end of said shaft than said first end of said arm member in said first position.

* * * * *